US010295291B2

(12) United States Patent
Ellis

(10) Patent No.: US 10,295,291 B2
(45) Date of Patent: May 21, 2019

(54) LESS-LETHAL FORCE DEVICE

(71) Applicant: Christian Ellis, San Diego, CA (US)

(72) Inventor: Christian Ellis, San Diego, CA (US)

( * ) Notice: Subject to any disclaimer, the term of this patent is extended or adjusted under 35 U.S.C. 154(b) by 0 days.

(21) Appl. No.: 15/386,281

(22) PCT Filed: Dec. 30, 2015

(86) PCT No.: PCT/US2015/068043

§ 371 (c)(1),
(2) Date: Dec. 21, 2016

(87) PCT Pub. No.: WO2017/116434

PCT Pub. Date: Jul. 6, 2017

(65) Prior Publication Data

US 2018/0292163 A1 Oct. 11, 2018

(51) Int. Cl.

| | |
|---|---|
| ***F42B 12/36*** | (2006.01) |
| ***F41A 21/32*** | (2006.01) |
| ***F42B 30/04*** | (2006.01) |
| ***F42B 30/06*** | (2006.01) |
| ***F41C 27/06*** | (2006.01) |
| ***F42B 12/02*** | (2006.01) |
| *F41A 21/34* | (2006.01) |

(52) U.S. Cl.

CPC ..... *F41A 21/32* (2013.01); *F41C 27/06* (2013.01); *F42B 12/02* (2013.01); *F42B 30/04* (2013.01); *F42B 30/06* (2013.01); *F41A 21/34* (2013.01)

(58) Field of Classification Search

CPC .. F41A 21/31; F41A 21/34; F41F 7/00; F42B 12/36

USPC ..... 102/502, 501, 85; 42/90, 106

See application file for complete search history.

(56) References Cited

U.S. PATENT DOCUMENTS

| | | | | |
|---|---|---|---|---|
| 1,900,790 A | | 3/1933 | Brandt | |
| 2,853,008 A | * | 9/1958 | Bowles | F42B 30/06 102/485 |
| 3,389,425 A | | 6/1968 | Termet | |
| 3,491,693 A | | 1/1970 | Streckfuss et al. | |
| 3,620,162 A | | 11/1971 | King | |
| 3,664,263 A | | 5/1972 | Driscoll | |
| 3,726,036 A | | 4/1973 | Jennings et al. | |

(Continued)

FOREIGN PATENT DOCUMENTS

| | | |
|---|---|---|
| EP | 0762075 | 12/1997 |
| FR | 604510 | 5/1926 |

(Continued)

*Primary Examiner* — J. Woodrow Eldred

(74) *Attorney, Agent, or Firm* — Kirk A. Buhler; Buhler & Associates

(57) ABSTRACT

Improvements in a less-lethal force device are disclosed. The less-lethal projectile device generally comprising a projectile that is mated to a docking base by way of a spherical shaped projectile ball in a retaining spherical sockets or base. The projectile ball may include a locating/orienting that locates the projectile ball in the docking base. The retaining socket has one or more wings that partially wrap around the projectile ball. The material, thickness and splits in the socket adjust the retention force placed on the projectile ball. The projectile captures a fired bullet and is propelled along the original path of the bullet at a less lethal velocity. The disclosed system results in converting a normally lethal weapon into a less-lethal blunt impact system.

16 Claims, 5 Drawing Sheets

(56) References Cited

U.S. PATENT DOCUMENTS

| | | | |
|---|---|---|---|
| 3,733,727 | A | 5/1973 | Jones et al. |
| 3,791,303 | A | 2/1974 | Sweeney |
| 3,898,932 | A | 8/1975 | Flatau et al. |
| 3,951,070 | A | 4/1976 | Flatau et al. |
| 3,982,489 | A | 9/1976 | Flatau et al. |
| 4,013,011 | A | 3/1977 | Gabriels |
| 4,030,421 | A | 6/1977 | Litman |
| 4,190,476 | A | 2/1980 | Flatau et al. |
| 4,505,179 | A | 3/1985 | Nelson et al. |
| 4,506,604 | A | 3/1985 | Hughes |
| 4,567,831 | A | 2/1986 | Gordon et al. |
| 4,747,349 | A | 5/1988 | Schilling et al. |
| 4,776,255 | A | 10/1988 | Smith |
| 4,793,259 | A | 12/1988 | Ambrosi et al. |
| 4,799,906 | A | 1/1989 | Perkins, Jr. |
| 4,823,702 | A | 4/1989 | Woolsey |
| 4,908,971 | A | 3/1990 | Chaney |
| 5,099,747 | A | 3/1992 | Smith |
| 5,257,936 | A | 11/1993 | Ambrosi et al. |
| 5,349,906 | A | 9/1994 | Devaux et al. |
| 5,377,438 | A | 1/1995 | Sheinfeld et al. |
| 5,448,937 | A | 9/1995 | Buc et al. |
| 5,574,245 | A | 11/1996 | Buc et al. |
| 5,654,524 | A | 8/1997 | Saxby |
| 6,408,765 | B1 | 6/2002 | Tauber et al. |
| 6,378,439 | B1 | 8/2002 | Saxby |
| 6,523,478 | B1 | 2/2003 | Gonzalez et al. |
| 6,619,179 | B2 | 9/2003 | Mika |
| 6,688,032 | B1 | 2/2004 | Gonzalez et al. |
| 6,981,449 | B2 | 1/2006 | Sadeck |
| 7,296,375 | B2 | 11/2007 | Brunn |
| 7,526,999 | B1 | 5/2009 | Timan |
| 2003/0019352 | A1 | 1/2003 | Mika |
| 2004/0069177 | A1 | 4/2004 | Klein |

FOREIGN PATENT DOCUMENTS

| | | |
|---|---|---|
| WO | 0111305 | 2/2001 |
| WO | 2013177603 | 5/2013 |

* cited by examiner

LESS-LETHAL FORCE DEVICE

CROSS REFERENCE TO RELATED APPLICATIONS

This application claims priority to International PCT/US15/68043 filed on Dec. 30, 2015 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in a less-lethal force device. More particularly, the present disclosure is for an accessory that is used with a law enforcement firearm to convert a lethal projectile into a less-lethal force projectile.

Description of Related Art Including Information Disclosed Under 37 CFR 1.97 and 1.98

Less-lethal weapon systems are well known in the art. Most less-lethal weapons require a complete weapon with a projectile that is included with the weapon. Examples include rubber bullets, electronic restraint devices, and the like. Many existing less-lethal systems do not allow law enforcement officers immediate access to the less-lethal weapon and do not allow law enforcement officers to have quick access to such devices in high-pressure emergency situations.

Less-lethal devices are designed to be used in critical situations, such as crowd control operations outdoors, or when an aggressor must be restrained in residential or public settings, including public transportation settings. Few devices of the prior art can be deployed within such a wide range of circumstances, allowing their use outdoors, indoors, and within confined, populated, and fragile spaces, such as the interior of airliners or businesses. Many devices are subject to a loss of potency, deterioration, or reliability due to age, temperature, and humidity. Finally, many prior art systems subject officers to a period of vulnerability during the transition from lethal, to less-lethal, and back to lethal weaponry.

A number of patents and or publications have been made to address these issues. Exemplary examples of patents and or publication that try to address this/these problem(s) are identified and discussed below.

U.S. Pat. No. 7,526,999 issued May 5, 2009 to Bruce A. Timan discloses a less-lethal Force Device. This device provides early elements of the device found in this disclosure. Use and testing of the product found in this patent has identified a number of improvements that were not obvious in the initial patent. While this patent identifies a less-lethal force device it does not disclose the improvements identified in this application.

U.S. Pat. No. 5,377,438 issued on Jan. 3, 1995 to Naftali Sheinfeld et al., discloses a device for preventing accidental discharging of a bullet from a firearm. This device captures a fires bullet but does not utilize a non-lethal projectile the travels from the firearm. While this patent covers a device to receive a projectile it does not include the features of this pending application.

U.S. Pat. No. 5,654,524 issued Aug. 5, 1997 and U.S. Pat. No. 6,378,439 issued Apr. 30, 2002, both to Michael Ernest Saxby disclose a marker projectile. The projectile includes internal ink or similar marking system where the projectile is propelled by air from a firearm. When the projectile reaches a target the inertia forces the marking substance to mark the target.

U.S. Patent Publication Number 2004/0069177 was published on Apr. 15, 2004 to John M. Klein discloses a Non-Lethal Projectile Ammunition. The projectile has a propellant that propels the projectile. The projectile is filled with an irritant such as pepper or similar medial that disperses upon impact with the ground. While this published application provides an irritant, the ammunition is self-propelled and does not convert a lethal projectile into a non-lethal projectile.

International publication WO 01/11305 was published on Feb. 15, 2001 for Tony Zanti discloses a Nonlethal Projectile Launched by a Lethal Projectile Discharged from a Firearm. The projectile has a series of fins that allow the projectile to fly. The fins prevent the rifling of the lethal projectile from allowing the non-lethal from spinning. The fins further increase the width of the non-lethal projectile thereby making the non-lethal projectile inoperable in a holster.

What is needed is a non-lethal projectile that captures a lethal projectile. The device is inserted over the end of a firearm thereby allowing the lethal firearm from being quickly converted with the use of a docking base. The proposed disclosure provides a solution to the problem.

BRIEF SUMMARY OF THE INVENTION

It is an object of the less-lethal force device to alter the projectile end of a firearm to a color such as Orange to identify that the weapon is less-lethal thereby notifying other law enforcement personnel that the projectile will be less lethal.

It is an object of the less-lethal force device for the projectile to embed in a slug that absorbs the lethal projectile. The slug can be metallic as well as other materials including but not limited to ceramics, composites.

It is an object of the less-lethal force device for the less-lethal projectile to be fabricated in an over-mold technique where the less-lethal projectile is fabricated using two or more materials where a first material is constructed to absorb the lethal projectile and the second material is constructed for impact with a target.

It is an object of the less-lethal force device to include grooves in the slug that help to retain the lethal projectile and improve guiding the lethal projectile into the less-lethal projectile.

It is an object of the less-lethal force device to adjust the weight or mass of the less-lethal projectile based upon the weight, mass, velocity and or load of the lethal projectile.

It is an object of the less-lethal force device to increase the sighting groove of the docking station to allow for better visibility and accuracy of the firearm.

It is an object of the less-lethal force device to increasing the size of the hole on the docking station to allow gases to escape thereby preventing back pressure in the docking station. The vents can also be oriented to either retain the docking station or to expel the docking station depending upon re-using the docking station or using expendable docking stations, respectively.

It is an object of the less-lethal force device to potentially lengthening the whole projectile to give a longer distance of deceleration when the less lethal projectile impacts a target.

It is an object of the less-lethal force device to add a pepper ball option that can further cause irritation to the target.

It is an object of the less-lethal force device to add a paintball or marker to the less-lethal projectile that will make it easier for law enforcement officers to identify an individual that was struck.

It is another object of the less-lethal force device to add a flash bang feature to the less lethal projectile to create temporary sight and or audible disorientation to a target.

It is another object of the less-lethal force device to provide a holster that holds a firearm with or without the less-lethal device inserted onto the firearm.

It is another object of the less-lethal force device to provide a deep cavity in the less-lethal projectile to slow the lethal projectile as the lethal projectile enters into the less-lethal projectile to ensure complete nesting of the lethal projectile.

It is another object of the less-lethal force device to changing the shape of the metallic slug for the metallic slug to be more aerodynamic and therefore not allow the projectile to tumble as the non-lethal projectile travels to the target.

It is another object of the less-lethal force device for the docking station to be manufactured with a material that provide sufficient friction to retain the docking station of the firearm and also sufficiently retain the non-lethal projectile until it is desired to release the non-lethal projectile using the lethal projectile.

It is another object of the less-lethal force device to include a material/coating/anodizing on the slug instead of using an injection molding method to coat the slug.

It is still another object of the less-lethal force device to use a round ball-like less-lethal projectile for crowd control to allow the round ball-like projectile to bounce or roll around the crowd where a specific target is not easily identified.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

Figure 8:
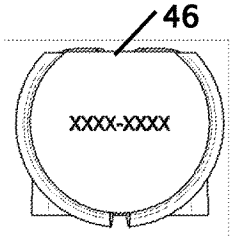

FIG. 8 a front view of the less-lethal projectile device.

Figure 9:
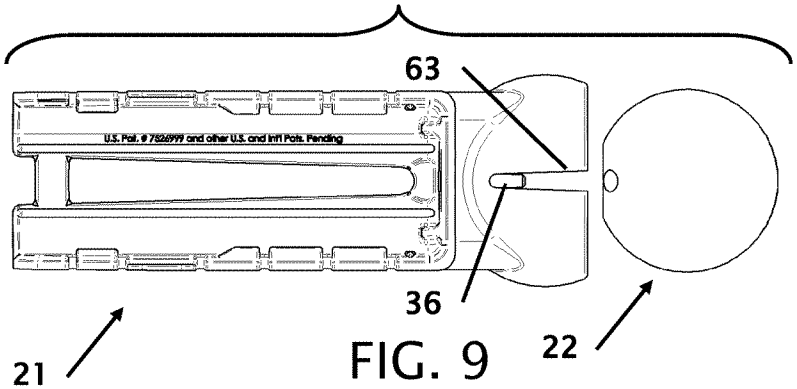

FIG. 9 is a bottom side view of the less-lethal projectile device with the projectile displaced.

DETAILED DESCRIPTION OF THE INVENTION

In operation, the fired bullet travels forward through the gun barrel towards the disclosed device. The bullet then leaves the barrel of the firearm, where a portion of the excess gas and energy generated during firing is harmlessly bled off, and immediately enters the mounting pins of the attached device. The bullet exits the mounting pins and is caught in the bullet trap portion of the projectile where it is slowed based upon the increase of mass between the projectile and the bullet trap.

The remaining kinetic energy of the bullet is transferred to the projectile, which is propelled forward, separating from the mounting pins and moving forward along the same line of travel as the bullet had taken. The projectile is now traveling at a lesser rate of speed and with less kinetic energy than the bullet had when it exited the barrel of the firearm. The speed and kinetic energy relationship is calculated into the design of the adjustable venting gasket and the vents on the mounting pin so as to bleed off a measured portion of the gas, taking into account the greater mass of the projectile and the projectile speed desired.

The docking base of the disclosed device is designed to clear from the firearm immediately following the departure of the bullet from the weapon. This action allows the weapon to instantaneously return to a lethal state in the event that the projectile misses its target or is ineffective in nullifying the threat, thereby making possible the application of lethality as necessary in an escalation of force situation. In another contemplated embodiment the docking base can remain on the firearm to allow for insertion of a subsequent non-lethal projectile.

Embodiments of the disclosed device may also be employed to breach semi-substantial barriers (i.e. windows, doors, light barricades) ahead of the delivery of chemical agents such as CS, CN, or Oleoresin *Capsicum* (pepper spray) as well as deliver chemical agents within the projectile, multiple ball sized projectiles or for the conveyance of leader filament attached to a docking line or rescue rope. Further embodiments may also be configured with field-adjustable vents to allow the officer to adjust the projectile speed at the point of use. Additional option such as but not limited to a flash bang, door bursting option, smoke grenade, bullet grenade, bullet propelled grenade (BPG), Bullet propelled device (BPD), grenade launcher, tear gas, door breaching, Taser-like prongs, and round ball-like alternative for crowd control features can be available options or features as an available arsenal of converting a lethal weapon to other non-lethal forms of the weapon by simply adding a docking station.

Variants of disclosed designs may include production of different models to accommodate a wide variety of specific firearms for use, with the disclosed system. Design considerations may include the caliber and weight of the ammunition, and the overall energy characteristics of the bullet fired from that particular weapon, as well as the desired projectile speed.

As a result of the disclosed system, the combination of the larger mass, increased cross sectional area, and the cushioned nature of the projectile, coupled with the reduced speed/kinetic energy of the projectile results in a normally lethal weapon being converted into a less-lethal blunt impact system.

Figure 1:
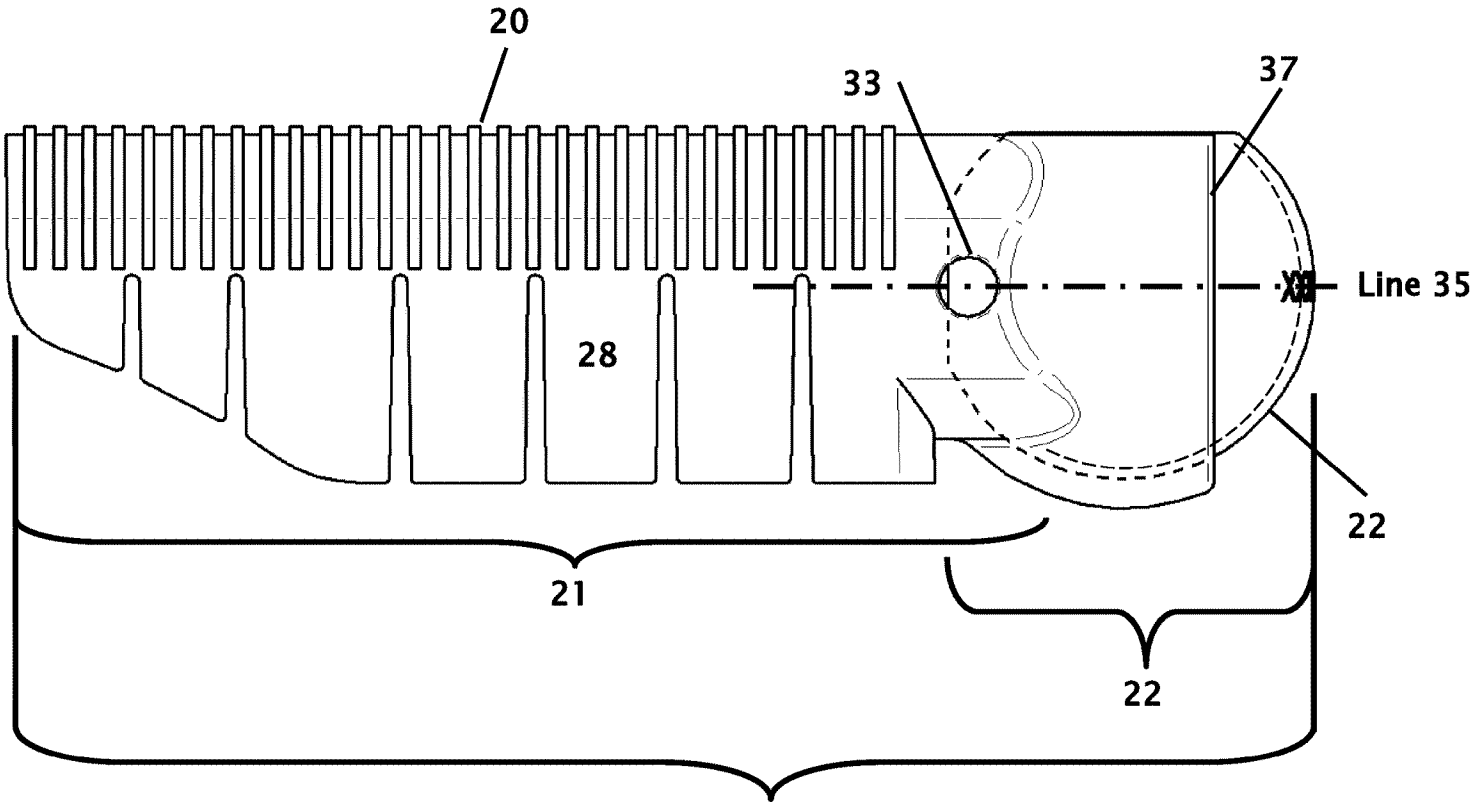
FIG. 1 is a side view of less-lethal projectile device configured in accordance with the teachings of this disclosure.

FIG. 1 is a side view of less-lethal projectile device configured in accordance with the teachings of this disclosure. The device 31 includes a docking base 21 where the projectile 22 is retained in a socket 37. This figure also shows a compression/expansion tab 28 that is formed into docking base 21 for providing a compression force to releasably attach the base to the barrel of a firearm, as will be more fully disclosed below herein. The components of the device 31 are preferably aligned along an axis Line 35, defined by the trajectory of a bullet passing the device 31. The projectile 22 has a centerline 35 that aligns the mounting base 21 with the centerline of the barrel of a firearm when the device 31 is properly installed.

The docking base can have vents, such as 33 to relieve pressure in such a manner as to prevent the projectile from prematurely being launched. As will be appreciated by those of ordinary skill in the art, the interior of the barrel is at normal atmospheric pressure prior to the firing of the bullet. After firing, the bullet travels forward and compresses this atmosphere, possibly resulting in the projectile being forced off the tube prior to the bullet being trapped in the bullet trap. Furthermore, as the seal between the bullet and the barrel is not absolute, some of the expanding gas leaks around the circumference of the bullet as the bullet travels through the barrel. This gas, along with the pressure being created in front of the bullet must be bled off or the projectile may become airborne before the bullet is captured and the kinetic force is transferred. The vents and gasket are preferably formed to allow enough pressurized gas to escape to facilitate the proper capture of the bullet by the projectile, thereby ensuring a consistent launch of the projectile. This escaping gas may be used to slightly pre-launch the projectile in order to preserve the kinetic energy of the bullet, and to facilitate maximum energy transfer of the bullet to the projectile. Consequently, as more gas energy is transferred to the projectile, the speed of the projectile will increase and the projectile will attain more knock-down power.

Figure 2:
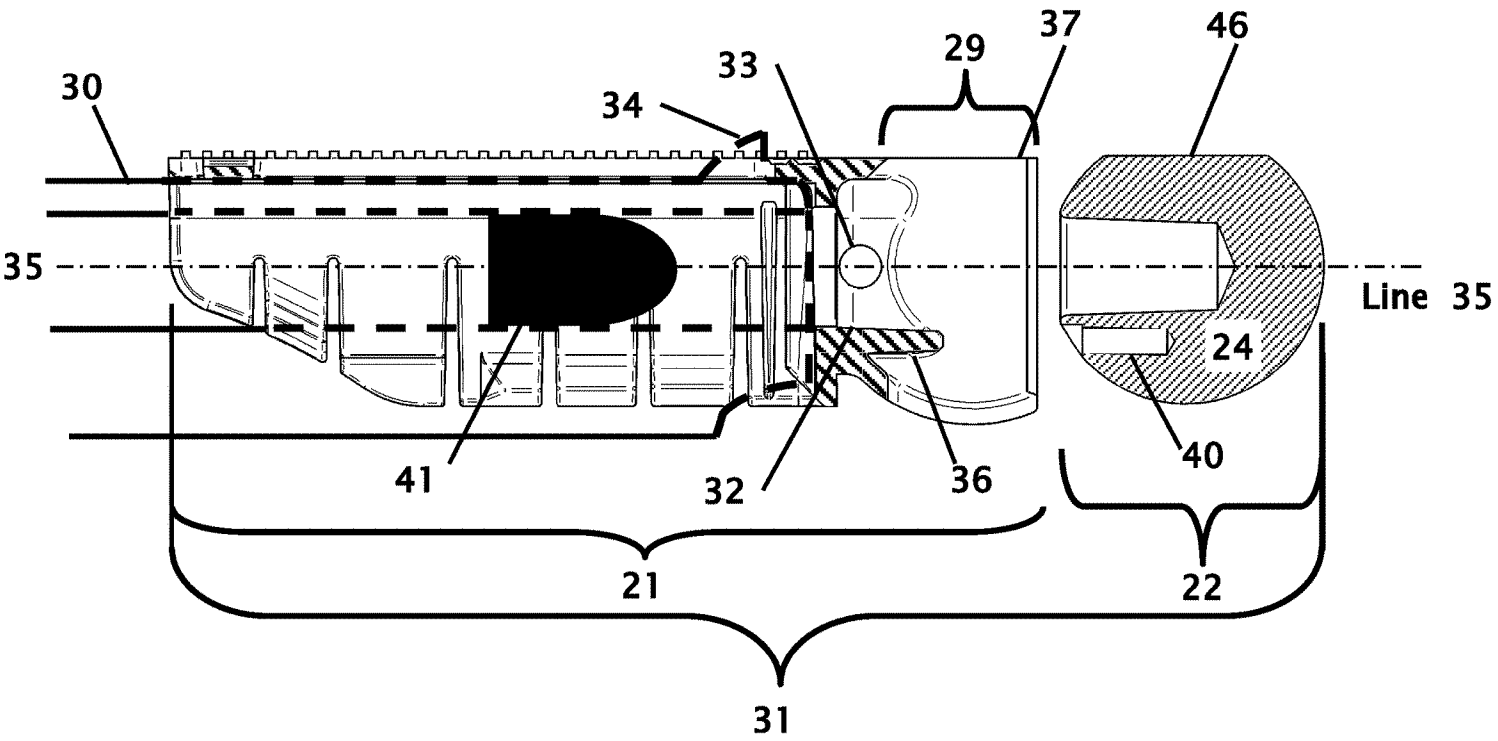
FIG. 2 is a side cross-sectional view of a less-lethal projectile device configured in accordance with the teachings of this disclosure.

FIG. 2 is a side cross-sectional view of a less-lethal projectile device 31 configured in accordance with the teachings of this disclosure. This figure illustrates the device 31 in operation and illustrate to capture and launching of a bullet 41 along Line 35. In a preferred embodiment, the projectile 22 comprises a metal or rubber projectile 24. The 46 top of the 22 is flat or concave to provide clearance for viewing down the sight 34 of the firearm 30 over the top 37 of the docking base 21. One or more vents 33 allows gasses from the firearm 30 to expel out the sides of the docking base 21. The size and the shape of the vents are sized to adjust the pressure/back-pressure. The docking base 21 has an alignment pin 36 that fits into a locating hole 40 in the projectile 22. The length of the alignment pin 36 ensures that the pin must be aligned with the hole 40 before the projectile 22 spreads the sides of the socket area 29 of the docking base 21.

Figure 3:
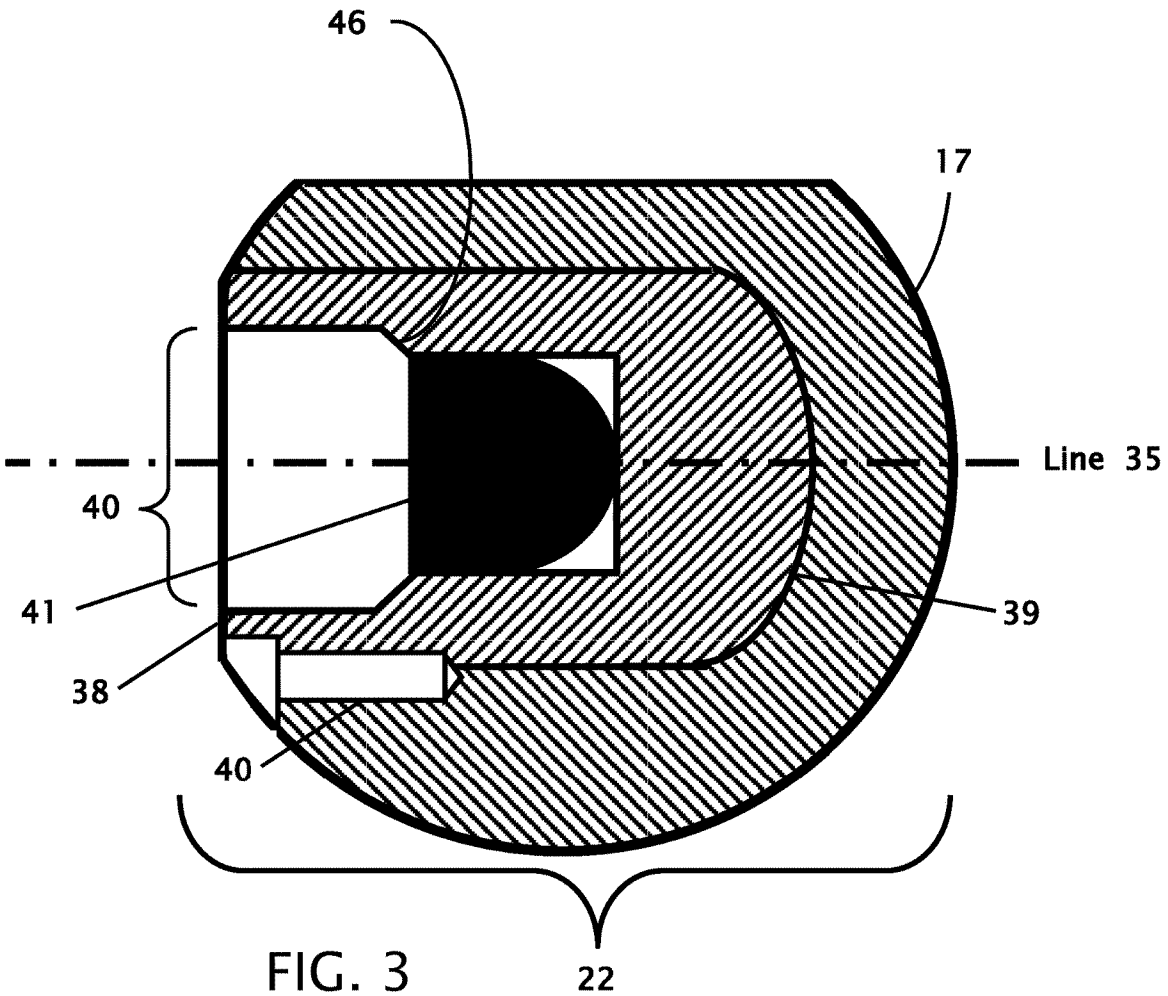
FIG. 3 is a side cross-sectional view of the projectile in another contemplated embodiment.

FIG. 3 is a side cross-sectional view of the projectile in another contemplated embodiment. It is contemplated that a one-piece projectile may be employed in the present disclosure. For example, a one-piece projectile may be created for a specific purpose, such as knocking open a door or window, destroying a lock on a locker without having a bullet flying around inside the locker, or for the delivery of chemical agents into a closed space.

This figure shows a rubber-cushioning sleeve is shown as including a forward end 17 and a rearward end 38, with the cylindrical surfaces of the sleeve defining an interior cavity 40. This figure also shows the interior cavity with a trapped bullet 41 captured therein. The projectile block 22 may be formed from metallic or other like material and is preferably cylindrical in shape. The material of the projectile block 22 is metallic but other materials are contemplated that can absorb the bullet 41 without rupturing or causing hazardous damage. The slug can be metallic as well as other materials including but not limited to ceramics, composites. It is also contemplated that the projectile block can be fabricated with multiple materials where one material created added mass with the other material provides best absorption of the bullet 41.

The forward end surface 17 of the projectile block 22 and the front surface of the rubber cushioning sleeve are preferably formed in a rounded, aerodynamic, manner, shaped to reduce air resistance and increase stability during flight. It is also contemplate to configure the outer surface of the projectile 22 with fins or rifling to allow the projectile to spin along with the rifling of the projectile bullet 41 as it travels through the barrel of the firearm. The outer surface or as a minimum the front surface 17 of the non-lethal projectile can be colored to identify that the weapon is less lethal thereby allowing other enforcement personnel and or the target to realize that the projectile is less lethal.

The optional sleeve or cover is preferably formed from a material of sufficient density such that air resistance in flight will not alter its shape, yet the force will be minimized upon impact with a target so as to impart only blunt trauma to the target. The sleeve may be glued or extruded onto the projectile block 22, and will extend the rear end 38 of the projectile block 22 to allow for impact cushioning should the projectile rotate during flight. It is contemplated that the sleeve or cover may be formed of synthetic or natural rubber, urethane, of either the open or closed cell variety. A wide variety of materials may be utilized, with the type and thickness being chosen in relation to the desired impact and type of weapon utilized. The top of the projectile 22 has a recessed area that may be tapered to guide the projectile bullet 41 into the trap of the less-lethal projectile 22. The locating/mounting pin recess 40 is shown in this figure.

The projectile block 22 may be disposed in the interior region of the rubber cushioning sleeve such that the rearward ends 38 and 43 of the projectile block 22 and rubber cushioning sleeve, respectively, are substantially aligned concentrically about the axis defined by Line 35. The rearward edge of 38 of the projectile block 22 may be inset within the rearward edge of the rubber cushioning sleeve between 1/16 and 3/8 of an inch, based on the application and the attributes of the specific weapon.

A chamfer transition region 46 is formed between the block mounting point 40 of the projectile block 22 and the bullet trap 6 to further reduce the interior diameter along the length of the projectile block 22. The bullet trap is formed about the axis defined by Line 35, and may vary in diameter depending on the caliber of bullet being fired from the weapon. The bullet trap is preferably slightly larger in diameter than the caliber of the bullet and specifically shaped to allow for some expansion of the bullet inside the trap at impact. This expansion allows a more gradual transfer of kinetic energy to the projectile, which both increases the accuracy of the device, and decreases the launch energy, or "kick" transferred to the shooter. The front nose 17 of the projectile block 22 is preferably shaped so as to minimize damage to the rubber-cushioning sleeve on both acceleration and impact.

The device utilizes the kinetic energy of a bullet 41 fired directly from the firearm into the device of this disclosure that has been attached proximal to the barrel of the firearm 30 (shown in FIG. 2). As the bullet 41 leaves the barrel of the firearm 30 along the path Line 35, the bullet enters into the projectile block 22 where a portion of the gas pushing the bullet 41 forward and may be bled off via optional venting gasket and exits through optional gas exhaust vents.

In flight, the projectile 22 now includes the mass of the bullet 41, plus the combined mass of the projectile block 22. This heavier, blunted projectile, having been accelerated with a decreased kinetic energy and having an increased cross-sectional area, contributes to the transformation of the lethal penetrating energy of the bullet into a less lethal blunt force device. The captured bullet in the projectile 22 thus becomes a less-lethal projectile.

It is contemplated that a wide variety of projectile configurations may be used in the present disclosure. One design criterion is the weight ratio of the projectile and bullet combination. Exemplary ratios will now be disclosed.

As will be appreciated by those of ordinary skill in the art, pistol bullets typically range in mass from 90 to 250 grains, with most in the 115 to 230 grain range with a typical load for a 9 mm being about 124 grains. In one preferred embodiment, the projectile block 23 of this disclosure ranges from 1 to 2 ounces (480 to 960 grains), and the rubber-cushioning sleeve 16 is a formed rubber cover weighing approximately 0.5 ounce, for total projectile weight of approximately 1.5-2.5 ounces.

In preferred embodiments, the projectile may range from approximately 1 to 100 times the mass of the bullet of the firearm. It is contemplated that this ratio imparts an effective less-lethal knockdown force on the target.

It is contemplated that the disclosed ratios may also apply to rifles as well as revolver-type pistols. However, in the case of rifles, there is no movement of the top slider to cause the docking base to auto-eject, and consequently it will have to be removed from the end of the barrel manually. Further embodiments of this device for rifles and more specialized weapons may utilize a combined docking base/projectile to eliminate the need for manual removal of the docking base from the barrel of the weapon.

Figure 4:
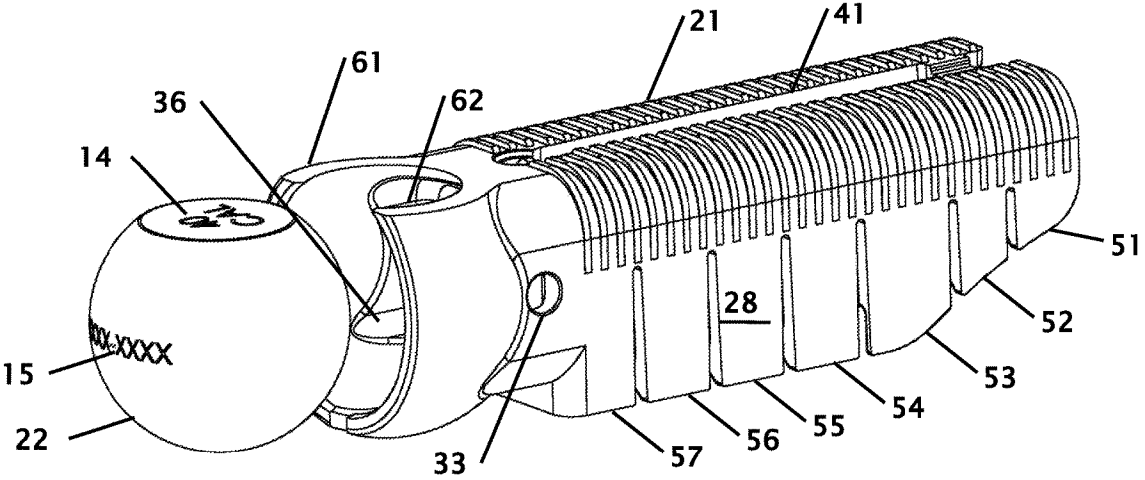
FIG. 4 is a top prospective view of the less-lethal projectile device with the projectile displaced.
Figure 5:
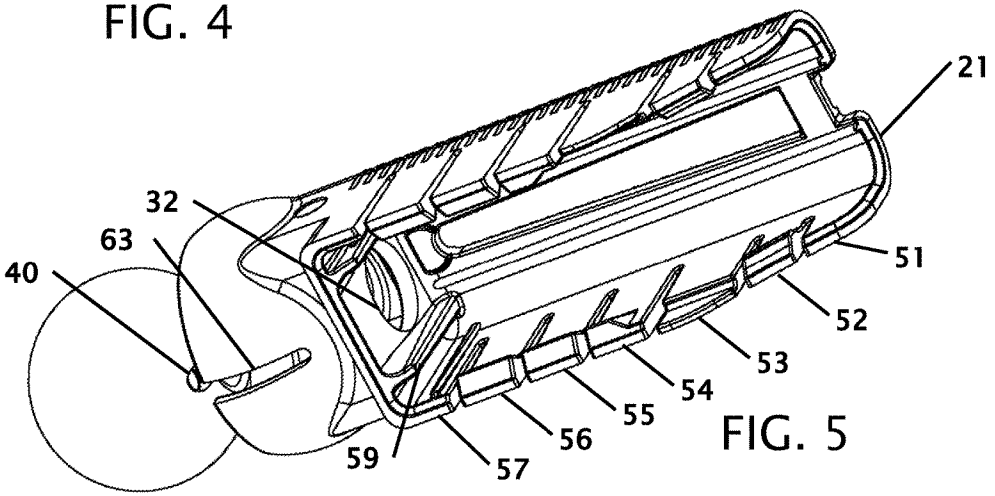
FIG. 5 is a bottom prospective view of the less-lethal projectile device with the projectile displaced.

FIG. 4 is a top prospective view of the less-lethal projectile device with the projectile displaced and FIG. 5 is a bottom prospective view of the less-lethal projectile device with the projectile displaced.

The gas exhaust vents 33 are sized so as to bleed off a certain portion of the expanding gasses created by the combustion of the gunpowder in the shell and the compression caused by the traveling bullet as described above.

These vents can be specially manufactured to create. For example, in testing using a .45 caliber 230 grain round, traveling at 815 feet per second (FPS) and a 2 ounce projectile, projectile speed varied from 240 FPS and 122 PSI (no gasket-four_" vent holes in the mounting tube) to 245 FPS and 128 PSI (no gasket-two_∝ vent holes in the mounting tube) to 250 FPS and 133 PSI (no gasket-no vent holes on the mounting tube) to 255 FPS and 138 PSI (gasket with two_" lots in the venting areas and no vents in the mounting tube) to 260 FPS and 144 PSI (full gasket, no slots in the venting areas and no vents in the mounting tube). Likewise, similar results were obtained in testing a 9 mm 115 grain round, traveling at 1160 feet per second (FPS) and a 2 ounce projectile, projectile speed varied from 215 FPS and 89 PSI (no gasket-four_" vent holes in the mounting tube) to 220 FPS and 92 PSI (no gasket-two_"vent holes in the mounting tube) to 225 FPS and 97 PSI (no gasket-no vent holes on the mounting tube) to 230 FPS and 101 PSI (gasket with two 11/64" slots in the venting areas and no vents in the mounting tube) to 240 FPS and 110 PSI (gasket with two slots in the venting areas and no vents in the mounting tube) to 245 FPS and 115 PSI (full gasket, no slots in the venting areas and no vents in the mounting tube). For comparison purposes a typical 12 gauge shotgun deployed 1.4 ounce beanbag round, traveling 300 FPS generates 134 PSI. The variable energy values obtained through the different venting options available with this device make it deployable in a greater range of situations and with more convenience than the typical less-lethal device.

In addition to the vents 33, a slot 63 at the underside of the docking base alters the amount of clamping force placed on the ball projectile 22. Based upon the material of the docking base 22, the dimensions of the various slots 63, wing (61 and 62) wrap, the amount force to install and remove the projectile 22 is adjusted. The slot 63 also alters the fabrication or molding of the docking base.

Referring more specifically to the docking base 21, it is contemplated that the docking base and tube 21 may be formed from a plastic or similar material, and serves as a collar, which is designed to snuggly attach to a firearm. Variants of the docking base 21 may be manufactured for a particular model of firearm so as to maintain alignment to the barrel of the firearm along the path defined by the travel of the bullet.

Referring generally now to FIG. 4. The rearward end of the docking base 21 may include one or more compression/expansion tabs 52, 53, 54, 55, 56 and 57, formed into the base 21 to facilitate expansion and contraction of the rearward end 51 of the docking base 21 so as to facilitate the removable attachment of the base to the forward end of a firearm. The compression/expansion slots 28 (52-57) may be formed to extend radially outward from the inner region of the base 21 outward through the outer surface of the base 21, forming compression members in the rear portion of the base 21. In FIG. 5 the tab(s) that engage onto the front of the firearm are shown along with the opening 32 where a bullet exits the firearm, passes through the docking base 21 and enters into the less-lethal projectile 22.

The size of the interior cavity of the docking base 21 is preferably formed so as to be slightly smaller than the outside surface of the firearm it is designed to fit, thereby requiring the outward flexing of the compression/expansion tabs of rear portion 51 when installing the base 21 onto a firearm. The number and size of these tabs 52-57 may be determined by the amount of compression force necessary to reliably and accurately seat the base 21 onto a particular firearm, assuring that the device remains properly aligned and affixed to the firearm. The mounting pin 36 are shown in a round configuration, but it is also contemplated that the pin 36 can be configured as triangular, square or other multi-sided configuration where the corners of the shape are deformed to grasp the projectile. The pin 36 fits into the recess 40 in the less-lethal projectile 22.

The docking base 21 is preferably formed with a slot 41 designed to fit around the front gun sight without affecting the weapon's alignment or function. The docking station can also be fabricated to enhance the sighting capability of the firearm and may further include material that glows or includes a battery that is illuminated when the docking station is inserted onto a firearm.

The less-lethal projectile 22 has indicia 14 on the top of the less-lethal projectile 22 that identifies the compatible caliber of the less-lethal projectile 22. Additional information may be included depending upon the gun powder or other information is also contemplated. Each less-lethal projectile 22 is serialized with indicia 15. This information can be used to determine the specific person that was issued the less-lethal projectile 22. This information can be used after the less-lethal projectile 22 has been used to determine who fired a particular less-lethal projectile 22.

It is also contemplated to include a paintball or marker to the less-lethal projectile that will make it easier for law enforcement officers to identify an individual that was struck.

A holster is also contemplated that can accommodate a firearm with or without the docking base and the less-lethal force device installed onto a weapon, thereby requiring a law enforcement person to turn the less-lethal device into a lethal device prior to firing the weapon.

Figure 7:
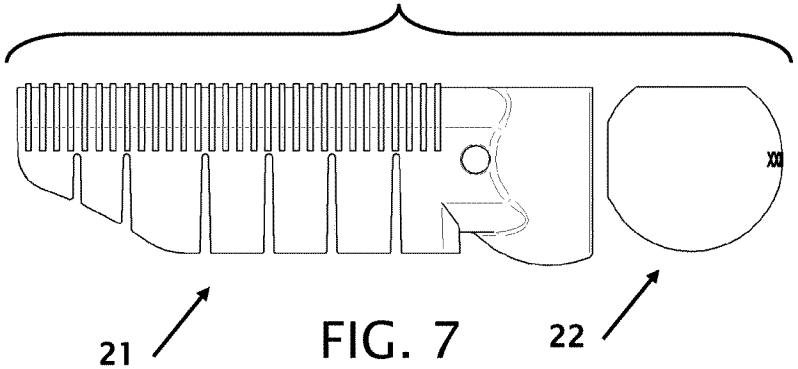
FIG. 7 is a side view of the less-lethal projectile device with the projectile displaced.
Figure 6:
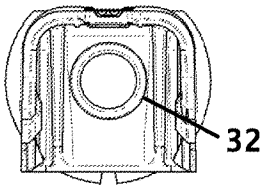
FIG. 6 is a rear view of the less-lethal projectile device.

FIG. 6 is a rear view of the less-lethal projectile device, FIG. 7 is a side view of the less-lethal projectile device with the projectile displaced, FIG. 8 a front view of the less-lethal projectile device and FIG. 9 is a bottom side view of the less-lethal projectile device with the projectile displaced. The projectile 22 is predominantly round and has a recessed area 46 that allows for use of the sighting system of the firearm to remain functional. The docking station 21 is further designed to reduce obstruction for mounting the flashlight or laser sight.

In another preferred embodiment the docking system 21 is more permanently fixed to the firearm. Two concave sides that clamp on both sides of the barrel use a magnetic coupling to maintain the docking station 21 on the firearm. This docking station 21 allows bullets to pass through the muzzle unobstructed, but still allow the projectile to mount on the dock 21. The underside of the barrel has a taper or reduced thickness area that is smaller in size than the area to the sides of the firearm. This underside area of the docking base can be used to grip the projectile mount when the dock is installed on a firearm.

While a particular configuration for a particular type of firearm is shown and described, it is contemplated that the mounting base operates on firearms including, but not limited to a Beretta M9, a SS P226, a Colt IV 45, a HK P2000, a SW 40 MP. While these mounting bases are shown for specific firearms, mounting for other firearms and bullets are contemplated, including but not limited to 5.56 (223), 7.62 (308), 338 Lapua, 50 BMG, 50 caliber and Magnum. The mounting base can further be configured as a flash suppressor that approximates the same weight as the stock. It is further contemplated that the mounting base can be a permanent attachment to a firearm. In another contemplated embodiment the mounting base can be configured as a shotgun choke.

Thus, specific embodiments of a less-lethal force device have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A less-lethal force device comprising:

a docking station having a rear portion and a forward concave mounting cavity, the rear portion being adapted to removably attach to a barrel of a firearm and receive a fired bullet from said firearm along a path defined by a travel of said fired bullet;

said forward concave mounting cavity having an opening between said rear portion and said forward concave mounting cavity for clear passage of said fired bullet along a path defined by a travel of said fired bullet;

a projectile having a spherical shape that fits within said forward concave mounting cavity;

said projectile further having an interior cavity;

said interior cavity being oriented along said path defined by a travel of said fired bullet, and said projectile being configured to capture said fired bullet into said interior cavity in a bullet trap, and detach from said forward concave mounting cavity as a result of kinetic energy transferred to said projectile from said fired bullet, and be accelerated along said path defined by a travel of said fired bullet to impart a less-lethal force upon a target.

2. The less-lethal force device according to claim 1, wherein said projectile has at least one flat or at least one concave exterior feature that provides clearance for aiming said firearm over said projectile.

3. The less-lethal force device according to claim 1, wherein said docking station further includes at least one projectile alignment pin.

4. The less-lethal force device according to claim 3, wherein said at least one projectile alignment pin extends from within said forward concave mounting cavity.

5. The less-lethal force device according to claim 1, wherein said projectile further includes at least one locating hole.

6. The less-lethal force device according to claim 5, wherein said at least one locating hole locates and/or orients said projectile in said forward concave mounting cavity.

7. The less-lethal force device according to claim 1, wherein said projectile further includes at least one of a unique identifying indicia and a caliber identifying indicia.

8. The less-lethal force device according to claim 1, wherein said forward concave mounting cavity is split on at least one location such that said forward concave mounting cavity hinges from said at least one split location to open said forward concave mounting cavity for insertion and expelling said projectile from retention in said forward concave mounting cavity.

9. The less-lethal force device according to claim 1, wherein said docking station includes holes in said forward concave mounting cavity for venting head pressure gasses generated from said fired bullet prior to said fired bullet entering said projectile.

10. The less-lethal force device according to claim 1, wherein said docking station is configured to be kicked off of a firearm as a result of the recoil of the firearm.

11. The less-lethal force device according to claim 1, wherein said bullet trap is slightly larger in diameter than the caliber of the fired bullet and configured to allow for expansion of the fired bullet inside said bullet trap at impact of said fired bullet within said bullet trap.

12. The less-lethal force device according to claim 1, wherein said docking station includes a plurality of tabs that provide compression forces on said barrel of said firearm to retain said docking station on said firearm.

13. The less-lethal force device according to claim 12, wherein said plurality of tabs are located on opposing sides of said docking station.

14. The less-lethal force device according to claim 13, wherein said docking station does not extend under a front portion of said firearm.

15. The less-lethal force device according to claim 14, wherein said docking station is installed and removed from said firearm with only vertical motion onto said firearm.

16. A less-lethal force device comprising:

a docking station having a rear portion and a forward concave mounting cavity, the rear portion being adapted to removably attach the base to a barrel of a firearm and receive a fired bullet from said firearm along a path defined by a travel of said bullet;

said forward concave mounting cavity having an opening between said rear portion and said forward concave mounting cavity for clear passage of said fired bullet along a path defined by a travel of said fired bullet;

said forward concave mounting cavity is split on at least one location such that said forward concave mounting cavity hinges from said at least one split location to open said forward concave mounting cavity for insertion and expelling said projectile from retention in said forward concave mounting cavity;

a projectile having a spherical shape that fits within said forward concave mounting cavity;

said projectile further having an interior cavity;

said interior cavity being oriented along said path defined by a travel of said fired bullet, and said projectile being configured to capture said fired bullet into said interior cavity in a bullet trap, and detach from said forward concave mounting cavity as a result of kinetic energy transferred to said projectile from said fired bullet, and be accelerated along said path defined by a travel of said fired bullet to impart a less-lethal force upon a target.

* * * * *